US011027158B1

(12) United States Patent
Black

(10) Patent No.: US 11,027,158 B1
(45) Date of Patent: Jun. 8, 2021

(54) FIRE RETARDANT PROPORTIONING SYSTEM AND APPARATUS

(71) Applicant: Thomas E. Black, Chico, CA (US)

(72) Inventor: Thomas E. Black, Chico, CA (US)

( * ) Notice: Subject to any disclaimer, the term of this patent is extended or adjusted under 35 U.S.C. 154(b) by 0 days.

(21) Appl. No.: 17/145,220

(22) Filed: Jan. 8, 2021

Related U.S. Application Data

(60) Provisional application No. 62/958,398, filed on Jan. 8, 2020.

(51) Int. Cl.
*A62C 5/00* (2006.01)
*A62C 35/68* (2006.01)

(52) U.S. Cl.
CPC ..... *A62C 5/002* (2013.01); *A62C 35/68* (2013.01)

(58) Field of Classification Search
CPC .. A62C 5/00; A62C 5/002; A62C 5/02; A62C 31/12; A62C 35/64; A62C 35/68; B01F 5/0413; B01F 5/043
See application file for complete search history.

(56) References Cited

U.S. PATENT DOCUMENTS 2,356,286 A * 8/1944 Morris ..... B01F 5/0411 137/7
3,115,158 A * 12/1963 Sheppard ..... A62C 5/02 137/565.33
4,805,700 A * 2/1989 Hoover ..... A62C 31/12 169/14
5,857,526 A * 1/1999 Manges ..... A62C 3/10 169/52
5,996,700 A * 12/1999 Sulmone ..... A62C 5/02 169/15
8,678,237 B2 * 3/2014 Harris ..... B67D 7/74 222/133
2006/0151184 A1 * 7/2006 Boyle ..... A62C 37/50 169/14
2010/0314137 A1 * 12/2010 Jackson ..... G05D 11/006 169/15
2015/0258356 A1 * 9/2015 Sulmone ..... A62C 5/02 169/15

* cited by examiner

*Primary Examiner* — Darren W Gorman
(74) *Attorney, Agent, or Firm* — Hamrick IP Law Office; Claude A. S. Hamrick

(57) ABSTRACT

Fire fighting apparatus using a single pressurizing pump and an improved eductor venturi to enable the in-line eduction of a long term fire retardant concentrate into a pressurized diluting water flow stream downstream of the water pressurizing pump so that the resulting mixture of water and liquid concentrate is accurately proportioned to meet a specification dictated by the concentrate vendor and is thus instantly available for application to fire threatened structures and vegetation.

10 Claims, 4 Drawing Sheets

FIRE RETARDANT PROPORTIONING SYSTEM AND APPARATUS

BACKGROUND OF THE INVENTION

Technical Field

The present invention relates in general to liquid fire-retardant concentrate proportioning means for use in fire fighting apparatus having a single pump and for enabling the mixing of the liquid concentrate with water at a vendor specified percentage so that the resulting mixture can be used in ground applied applications without pre-mixing or batch mixing in an apparatus tank.

Alternatively stated, the present invention relates to a novel means adapted to provide a pressure controlled stream of water and to use the pressurized stream to proportionately educt liquid long term fire retardant (LTFR) chemicals at a vendor specified percentage from a source of a concentrate thereof, and to simultaneously introduce the educted concentrate directly into the pressurized stream to mix the concentrate with the pressurized water so that the resulting mixture may be immediately dispensed onto fire threatened structures and/or vegetation to suppress or prevent ignition and resulting fire.

Prior Art

It is well known that various forms of fire retardant or extinguishing chemical powders, gel concentrates, foam concentrates and other solute concentrates can be mixed with water to provide a fire fighting mixture that can be sprayed or otherwise applied to structures and vegetation to suppress, control, and/or extinguish an ongoing or oncoming wildfire.

It is further well known that various forms of fire suppressing or extinguishing chemical powders, gel concentrates, and foam concentrates can be mixed with water to provide various fire fighting solutions that can be sprayed or otherwise applied to structures and vegetation to suppress, control, or extinguish an ongoing or oncoming wildfire.

For example, in U.S. Pat. No. 3,115,158 issued to A. G. Sheppard, an apparatus is disclosed for making air-foam for fire extinguishing purposes. In the described prior patent, water and a foam liquid are carried in suitable tanks on a fire truck or other vehicle having two centrifugal pumps; one for supplying the water under pressure, and the other for supplying the foam liquid under pressure. Both pumps are driven by the truck engine. As stated in the patent, the water pressure and foam liquid pressure are so correlated by the dual pumps as to establish, in cooperation with a venturi, pressure differentials which control the discharge of the foam liquid. Such control is achieved by means of a check valve located in the foam supply line and adapted to open in a downstream direction in response to pressure drop in the venturi throat occasioned by liquid flow therethrough.

However, the Sheppard invention has the disadvantage of requiring the use of two separate pumps to pressurize both water and foam liquid and uses a swing check valve to create a differential pressure to gate the foam input to the mixing element, i.e., to turn on and off the flow of foam so as not to waste the foam when the flow control nozzle is opened and closed.

In addition, whereas the Shepard approach is suitable for use with foam liquids that will work over a broad range of mixture proportions, it is not well suited for use with non-foam liquids wherein the mixing ratio is much more critical.

Principal Objectives of the Present Invention

A principal objective of the present invention is to provide an improved system and apparatus for mixing and applying long term fire retardant (LTFR) solutions to structures and vegetation that may be threatened by wildfire.

Another objective of the present invention is to provide an improved system and apparatus for mixing and applying long term fire retardant (LTFR) solutions that can be effective for substantial periods of time.

Another objective of the present invention is to provide a relatively light-weight and compact fire-fighting apparatus that can be transported by a wide range of vehicle types into otherwise inaccessible areas threatened by wildfires.

Still another objective of the present invention is to provide an apparatus that can reduce the handling and mixing of caustic and corrosive LTFR chemical concentrates and allow them to be drawn directly from their vendor-supplied containers and accurately mixed in the correct proportions with transported or otherwise available water.

Yet another objective of the present invention is to provide a simple and compact chemical mixing and proportioning apparatus that can be incorporated into a transportable fire-fighting water pumping and hose carrying skid.

Another objective of the present invention is to provide an improved chemical concentrate and water proportioning apparatus that once setup requires little adjustment during use in otherwise inaccessible areas threatened by wildfires.

Another objective of the present invention is to provide an improved chemical and water proportioning apparatus that is relatively easy to clean and care for in-between uses.

Another objective of the present invention is to provide an improved chemical and water proportioning apparatus that is relatively easy to assemble using readily available tools and component parts.

Still another advantage of the present invention is that vender supplied concentrate containers can be used to eliminate the need to pour the water and concentrate material into a separate tank for mixing and/or storage, thereby reducing material waste and simplifying cleanup.

BRIEF SUMMARY OF THE INVENTION

With the above objects in mind, the present invention presents a novel system and apparatus for enabling the in-line eduction of a long term fire retardant concentrate into a pressurized and diluting water flow stream downstream of a water pressurizing pump so that the resulting mixture of water and liquid concentrate is accurately proportioned to meet a specification dictated by the concentrate vendor and is instantly available for application to fire threatened structures and vegetation.

An immediately apparent advantage of the present invention is that it can be used to accurately and predictably withdraw long-term fire-retardant concentrate from one or more containers while simultaneously mixing the concentrate with pressurized water at a specified ratio and proportion, and the mixture can be simultaneously applied directly to structures or vegetation threatened by wildfire.

Another advantage of the present invention is that vender supplied concentrate containers can be conveniently used on a skid to eliminate the need to measure and pour the water and concentrate into a separate tank for mixing and/or storage, thereby reducing material waste.

These and other objects and advantages of the present invention will no doubt become apparent following an inspection of the ensuing drawing figures together with a reading of the following detailed description and the appended claims, taken in conjunction with the foregoing background discussion.

IN THE DRAWING

Figure 2:
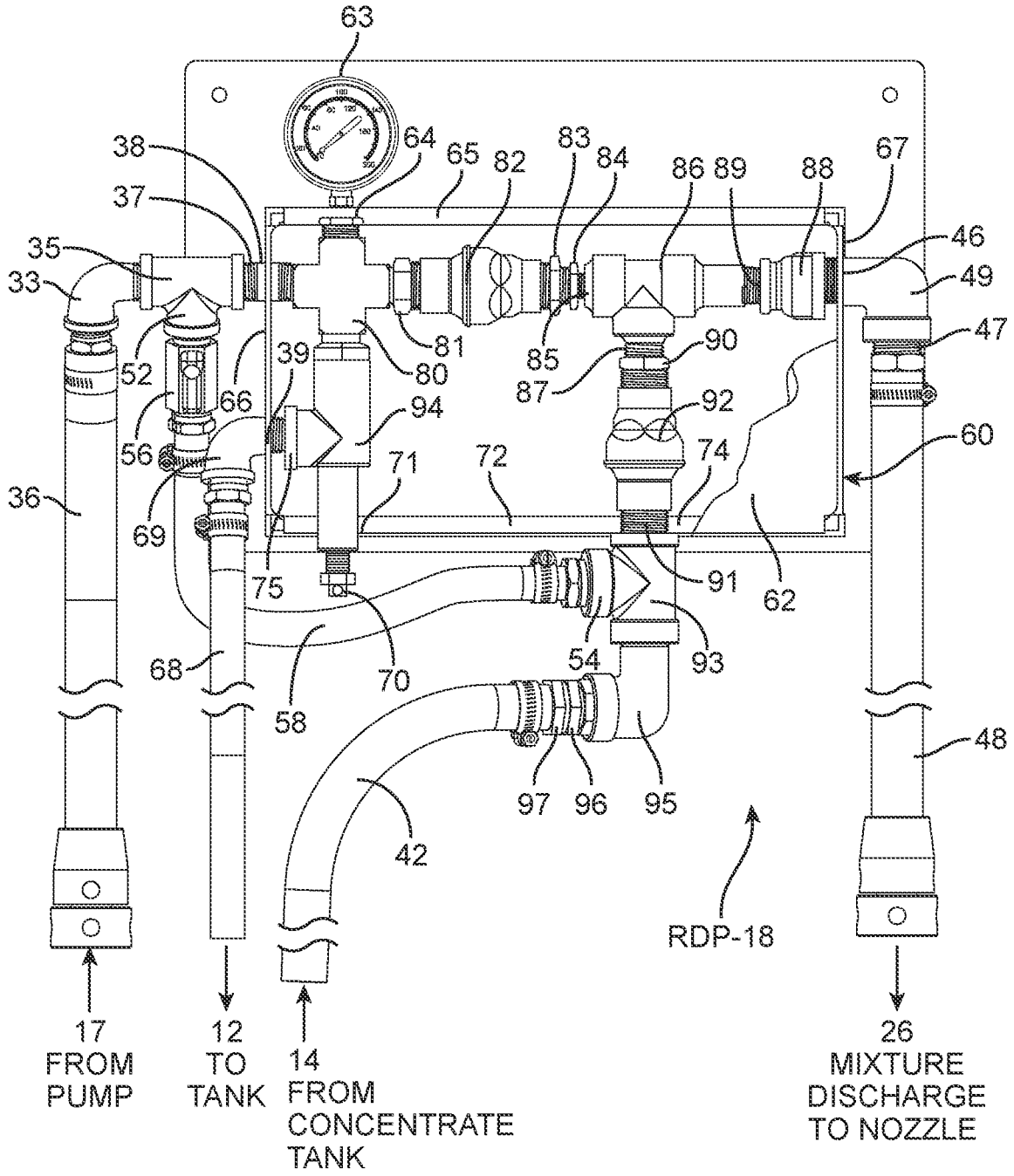
FIG. 2 is an uncovered frontal view showing an assembly of the various component parts assembled to implement an embodiment of the fluid educting and mixing components of a preferred embodiment of the present invention.
Figure 3:
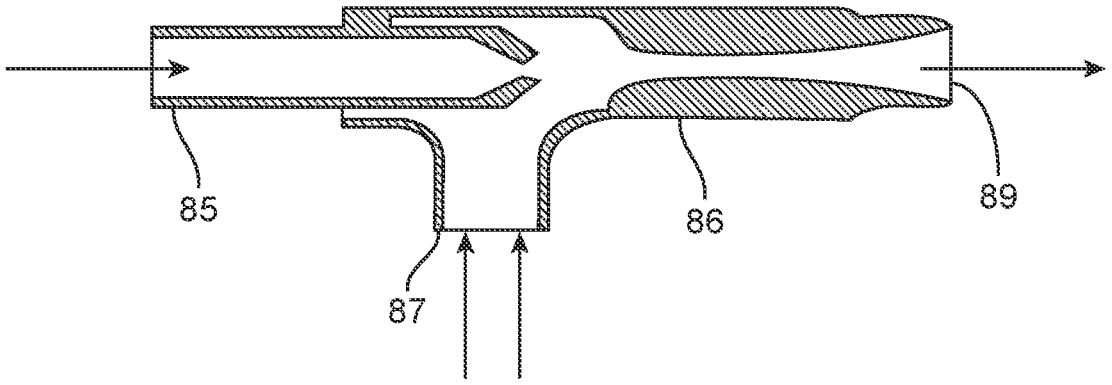

FIG. 3 pictorially illustrates an eductor venturi of a type that might be used in an embodiment of the fluid educting and mixing component illustrated in FIG. 2 of the Drawing.

Figure 1:
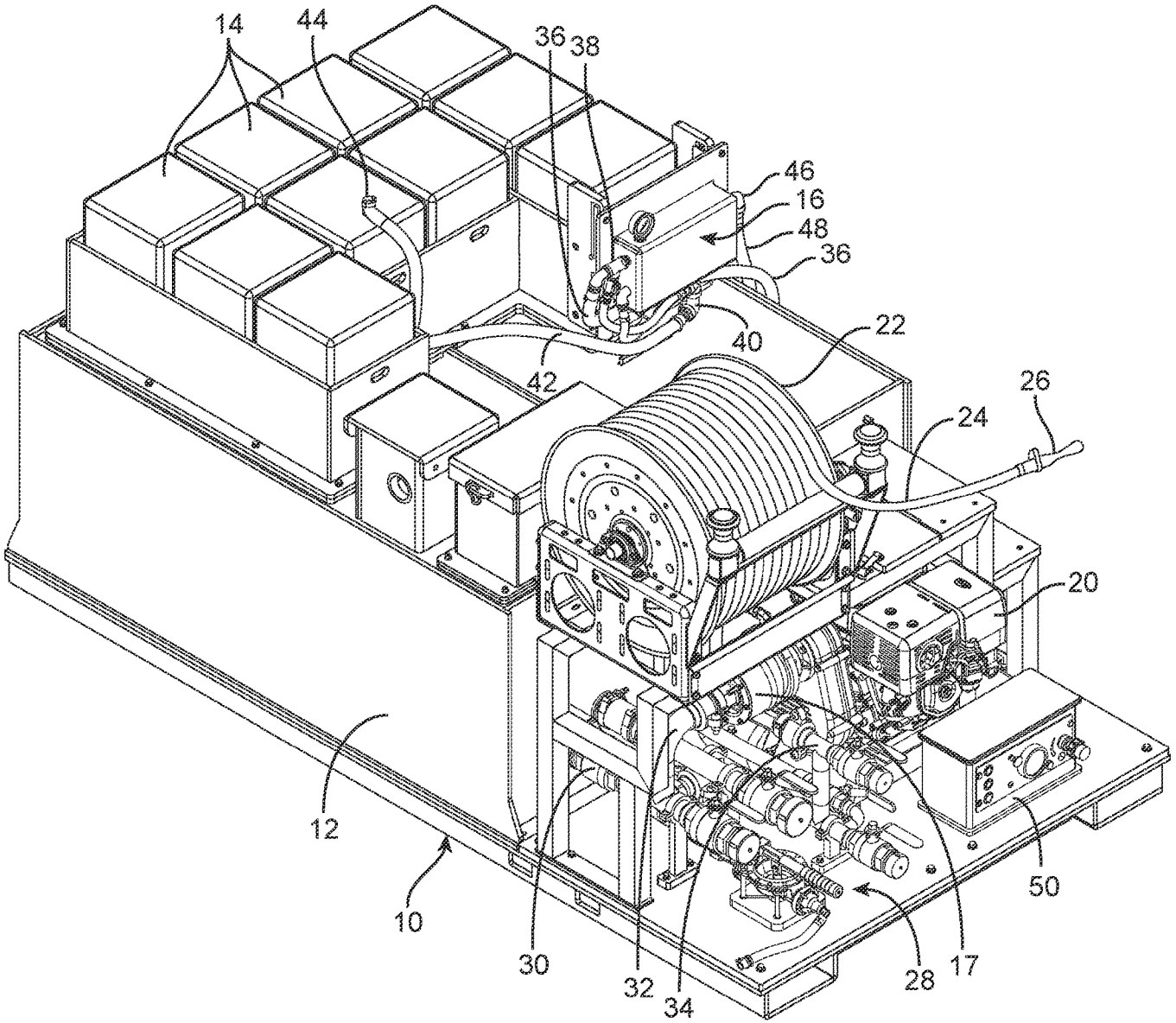
FIG. 1 is a simplified perspective view showing an embodiment of a skid mounted system and apparatus of a type generally contemplated for use with an embodiment the present invention.
Figure 4:
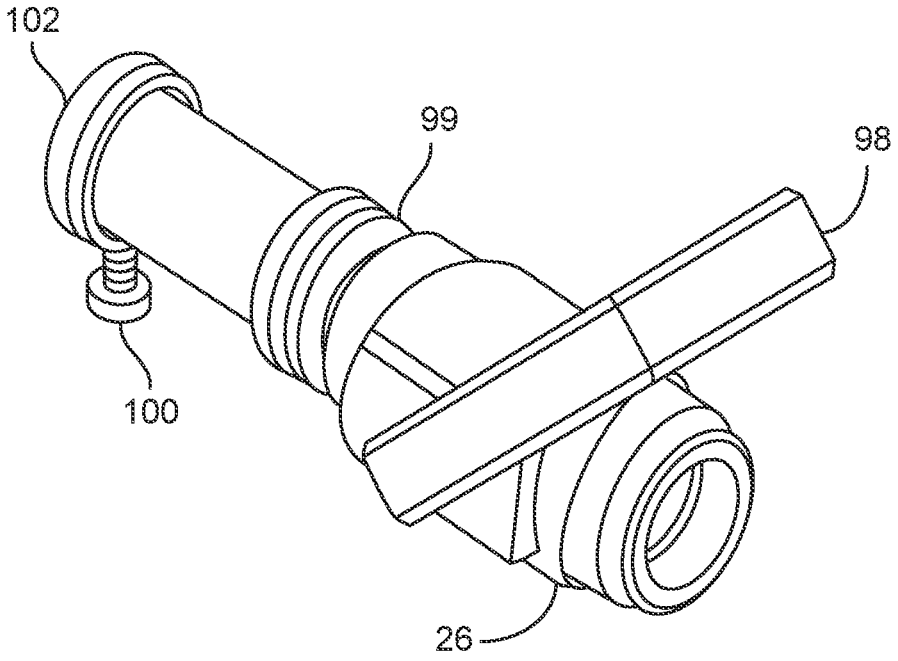
Figure 5:
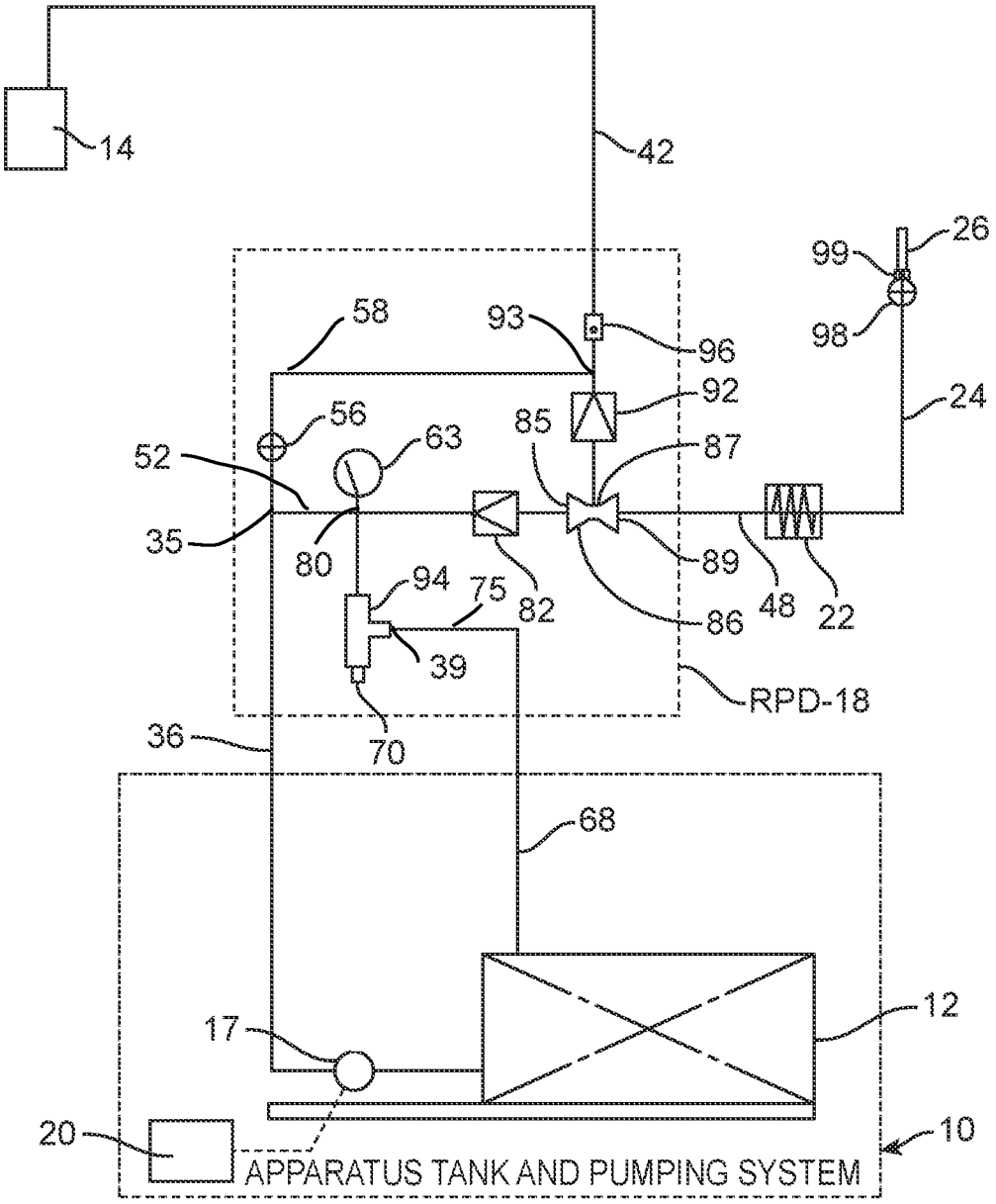

FIG. 4 is a pictorial view generally showing an embodiment of a standard fire hose nozzle modified for use at the end of the fire hose depicted in FIG. 1, and FIG. 5 is a schematic diagram illustrating operation of the principal operational components of the presently preferred embodiment of the present invention shown in FIGS. 2-4 as integrated with the skid apparatus shown in FIG. 1.

DETAILED DESCRIPTION OF THE ILLUSTRATED EMBODIMENT

Referring now to FIG. 1 of the Drawing, which generally illustrates at 10 a skid mounted fire-fighting system and apparatus designed to be mountable upon otherwide carried by a vehicle (not shown) such as a pickup truck, a modified Utility ATV, a UTV, a Jeep, or a trailer pulled by such vehicles or the like.

The depicted skid 10 is of a type designed to extract fire-fighting chemicals or concentrates contained in one or more containers 14, and to mix the extracted chemicals with pressurized water and to then use the resulting mixture to suppress and/or extinguish wildfires. The illustrated skid is a system and apparatus such as the MTECH POLY-TOUGH™ Skid apparatus comprised of a 300-gallon MTECH PolyTough™ water tank 12; a water pressurizing pump 17, such as the Waterax Striker 3, 3-stage centrifugal pump, for pressurizing water withdrawn from tank 12; a gasoline engine 20, such as the Honda, 13HP, electric start engine, for driving the pump 17; one or more chemical vendor supplied containers 14 respectively filled with one or more types of chemicals to be withdrawn from and mixed at a pre-specified ratio with pressurized water obtained from tank 12; and a suitable proportioning and mixing subsystem such as that generally illustrated at 16.

Skid 10 further includes a hose reel assembly 22 carrying a fire hose 24 having a suitable nozzle 26 affixed to the distal end thereof; and an assembly of plumbing elements and valves 28 for interconnecting the several fluid handling, directing and processing system components.

Tank 12 has an outlet port 30 connected to an intake port 32 of pump 17 which in turn has an outlet port 34 connected via suitable tubing, piping or other forms of fluid conduit 36 to a pressurized water inlet port 38 of subsystem 16. Subsystem 16 has a chemical inlet port 40 connected by a suitable conduit 42 to an outlet port 44 of at least one of the containers 14. Subsystem 16 also has a water/chemical mixture outlet port 46 connected by a conduit 48 to the proximal end (not shown) of the fire hose 24 wrapped about reel assembly 22. An example of the hose reel assembly 22 is a Hannay electric hose reel mechanism having 150 feet of ¾" I.D. Booster Hose wound thereabout.

Also mounted on the skid and depicted in FIG. 1 is a control unit 50 for accommodating various system operator control functions. The unit 50 might for example include inter alia, a master power switch, a means for controlling hose reel rewind, a low power shutdown switch, an engine start button, an engine control throttle, a choke knob, a water pressure gauge, and a low oil indicator light.

In operation, water drawn from the tank outlet port 30 is pressurized by the motor driven pump 17 and fed via conduit 36 to the subsystem 16 where it is mixed with chemicals drawn via a suction hose 42 and mixed in the subsystem 16 with the pressurized water drawn from the tank 12.

The resulting mixture is then output at an output port 46 and forced through a conduit 48 connected to the proximal end (not shown) of the fire hose 24 after it is unwound from reel 22, and then discharged through a nozzle 26 (FIG. 1) connected to the distal end of the fire hose 24. The liquid mixture discharged from nozzle 26 can be sprayed on structures or vegetation to suppress and/or extinguish an ongoing wildfire.

In accordance with a preferred embodiment of the present invention, the illustrated proportioning and mixing subsystem 16 of FIG. 1 has been replaced with a novel and improved proportioning and mixing system and apparatus depicted in FIG. 2 of the Drawing, hereinafter described as a retardant proportioning device (RDP) 18, or the "RDP-18 subsystem" for effecting the proportioning and mixing of chemical concentrates with pressurized water. For convenience and internal consistency, except as explained above, the call-out numbers used in FIG. 1 will continue to be used in the several Figures of the Drawing.

Turning now to FIG. 2 of the Drawing, an improved fire-fighting system and apparatus including a skid, or the like, having supporting operative components such as those illustrated in FIG. 1, is combined with the novel subsystem and apparatus identified herein as the RDP-18. The improved fire-fighting system is specifically designed to educt and mix particular types of chemical concentrates known as liquid long term fire retardant (LTFR) concentrates, such as for example, that manufactured by ICL Performance Products, LP, and marketed as Phos-Chek LC95A-FX. The RDP-18 subsystem is depicted as including a housing 60 with its front cover plate 62 partially broken away to reveal the internal operational components thereof.

As illustrated, a 0-300PSI water pressure reading gauge 63 is shown to extend through an opening 64 in the upper wall 65 of housing 60. The pressurized input water enters housing 60 from line 36 through an opening 38 (entry port 38) in the left side wall 66 of housing 60 via a ¾" street EL 33, a ¾" high pressure Tee 35, and a ¾" nipple 37. An "excess water" return line to tank 12 (FIG. 1) extends from a regulator branch port 75, via a ½" street EL 69, extending through a second opening 39 in the left side wall 66 and thence to the return conduit 68 leading to tank 12. The mixed solution output from RPD-18 flows through a street EL 49 extending through an output port 46 in the right-side wall 67, and thence through the discharge hose 48 to reel 22 (FIGS. 1 and 5) where it is joined to discharge hose 24 and nozzle 26.

Returning to FIG. 2, a pressure regulator adjustment screw 70 extends through lower housing wall 72 at 71, and the concentrate input line represented by the conduit 42 extends through another opening 74 in the lower housing wall 72 via a swivel 97, a metering orifice 96, ¾" Tee 93 and a ¾" nipple 91.

Disposed within housing 60 and extending across the upper portion thereof between the nipple 37 (passing through of the pressurized water input port 38), and the water/concentrate mixture outlet port 46 via street EL 49, are (from left to right) a four-way ½" cross connector 80, a ½"×¾" flow expander 81, a ¾" check valve (0.5 PSI cracking pressure) 82, a ¾"×½" flow reducer 83, a ½"×¼" flow reducing adapter 84 connected to the motive port 85 of an eductor venturi 86, such as that generally illustrated in FIG. 3, having its discharge port 89 connected to a ½"×¾" flow expander 88 coupled to the street EL 49 affixed to the proximal end 47 of discharge hose 48 (FIGS. 2 and 5), which in turn is connected to the proximal end of the fire hose wrapped about the reel 22 shown in FIG. 1.

As depicted in FIGS. 2, 3 and 4, the suction port 87 of eductor venturi 86 is connected via check valve 92 (0.5 PSI cracking pressure), the nipple 91, the Tee 93, the street EL 95, the concentrate metering orifice 96 and the swivel 97 to the ¾" suction hose 42. The eductor venturi 86 is custom designed and manufactured to allow a constant and fixed flow rate (GPM) therethrough at a given pressure while creating the necessary suction to draw a pre-specified flow of retardant concentrate from container 14, and through metering orifice 96 and check valve 92, and into suction port 87 to provide an 18% mix of water and retardant (5.5 to 1) out of the discharge port 89 of eductor venturi 86.

Coupled to the lower branch of cross connector 80 is a 0-300 PSI pressure relief valve 94 used in conjunction with the adjustment screw 70 and gauge 63 as a pressure regulator to control the water pressure input to the RDP-18. The relief valve 94 works to by-pass excess water at the regulator to return via its branch port 75 whereby it is returned through street EL 69 and line 68 to tank 12. Although pressurized water is provided by pump 17 (FIG. 1) at approximately 125 PSI, it is preferably reduced to 110 PSI by regulator 94 and held constant thereby.

Referring now to FIG. 4, a standard fire-hose nozzle 26 is shown including an ON/OFF lever 98 and a discharge pattern adjustment screw 100 for controlling the output spray shape as it exits the nozzle at its discharge end 102. In addition, a metering orifice (flow restrictor) 99 is also included in nozzle 26 to ensure that the fire retardant is discharged at a constant flow rate (GPM) and pressure in all pattern settings. Moreover, the discharge hose 24 (FIG. 1) and metering orifice 99 are sized to allow for a 50% drop in pressure across the eductor venturi 86.

As alluded to above and further explained below with respect to FIGS. 2 and 5, another important feature of the present invention is the subsystem flush capability provided by the flow circuit between the branch port 52 of Tee 35, the ball valve 56, the flush tube 58 and the branch port 54 (FIG. 2) of Tee 93.

In operation, (as schematically depicted in FIG. 5 of the Drawing), and with the nozzle 26 opened, water contained in tank 12, or otherwise obtained from an available source, is pumped through tube 36 by pump 17 at a pressure 10 to 15 PSI higher (for example 125 PSI) than the normal regulated pressure of RPD-18, i.e., 110 PSI for example, water entering RPD-18 through the high-pressure tube 36 at 125 PSI is regulated to a predetermined pressure (e.g., 110 PSI) by reading the pressure gauge 63 while setting the pressure regulator 94 using adjusting screw 70, and with water flowing through the discharge nozzle 26. As the pressure is reduced, the unused water by-passes through the regulator and is returned to the tank 12 through the hose 68.

As the pressurized water flows through check valve 82 and into the motive port 85 of eductor venturi 86, the pressure drops therewithin creating suction at the suction port 87, thereby drawing retardant concentrate from container 14 through concentrate hose 42, metering orifice 96, check valve 92 and into the pressurized water stream passing through venturi 86. In so doing, the water and concentrate are thoroughly mixed in the venturi 86, and the mixed solution thereupon passes out of the discharge port 89 thereof and through the conduit 48, reel 22, fire-hose 24, the ON/OFF valve 98, and the constant flow orifice 99 and pattern adjustment screw 100 of nozzle 26 for spraying on structures and/or vegetation being treated.

Following use, in order to clean the entire RPD-18 subsystem, the concentrate hose 42 should be withdrawn from the concentrate container 14, and the nozzle 26 should be opened. Opening the flush valve 56 will allow the pressurized water input at 38 to flow through the entire subsystem and exit through the open nozzle 26 and suction tube 42. This will clean the entire subsystem and clear any clogs that may have occurred.

Should the pump 17 not be turned OFF before the nozzle 26 is opened, the check valve 82 will stop mixed solution in the discharge line 48 from returning to the excess water return line 68 and contaminating the water tank 12 and pumping system should the flush valve 56 be opened.

Similarly, should the suction tube 42 not be removed from the concentrate container 14 before the nozzle 26 is opened, and the flush valve 56 be opened, check valve 92 will stop flow-back of mixed solution back to the concentrate container 14 thereby preventing dilution of the concentrate in the container.

It will thus be recognized that the RDP-18 is substantially foolproof in operation, that once setup requires little adjustment during use in otherwise inaccessible areas threatened by wildfires, that it is safer to use in that it reduces the handling and mixing of caustic and corrosive LTFR chemical concentrates by allowing them to be drawn directly from their vendor-supplied containers and accurately mixed in the correct proportions with transported or otherwise available water, that it is relatively easy to clean and care for in between uses, that it is relatively easy to assemble using readily available tools and component parts, that vender supplied concentrate containers can be used to eliminate the need to pour the water and concentrate material into a separate tank for mixing and/or storage, thereby reducing material waste and simplifying cleanup. and that it represents a true advancement over other prior art systems.

The preceding description provides a preferred exemplary embodiment of the invention only, and is not intended to limit the scope, applicability, or configuration of the invention. Rather, the description of the preferred exemplary embodiment is intended to provide those skilled in the art with an enabling disclosure for implementing an embodiment. It is to be understood that various changes may be made in the function and arrangement of the described components and elements without departing from the true spirit and scope of the invention set forth in appended claims.

The invention claimed is:

1. A fire retardant concentrate proportioning system and apparatus for proportioning and mixing one or more concentrated liquid chemicals with pressurized water, comprising:

a first input port for connection to a source of water pressurized to a first pressure;

a selectably variable pressure regulator connected to said first input port for reducing the pressure of water input thereto from said first pressure to a selected second pressure;

a second input port for connection through a metering orifice to a source of liquid chemical concentrate having a predetermined concentration;

a first check valve;

a second check valve;

an output port; and an eductor means having a motive port fluidly connected by said first check valve to said pressure regulator for receiving a stream of water pressurized thereby to said selected second pressure, a suction port fluidly connected by said second check valve to said second input port for receiving liquid chemical concentrate from said source thereof, and a discharge port fluidly connected to said output port, said eductor means being configured such that the velocity of flow of pressurized water therethrough induces a negative pressure at said suction port which induces a predetermined flow of said liquid chemical concentrate through said metering orifice and said second input port and into said suction port where it becomes mixed with said stream of pressurized water, the resulting mixture being discharged through said discharge port to said output port and through any hose and nozzle connected thereto.

2. A fire retardant concentrate proportioning system and apparatus as recited in claim 1 wherein said selectably variable pressure regulator is a pressure relief valve having an adjustment screw and an associated branch port and by-pass linkage for returning excess pressurized water to the source of water.

3. A fire retardant concentrate proportioning system and apparatus as recited in claim 2 wherein said selectably variable pressure regulator further includes a pressure gauge for indicating the pressure of the water input to said eductor means as said adjustment screw is adjusted to reduce said first pressure to said second pressure.

4. A fire retardant concentrate proportioning system and apparatus as recited in claim 2 and further comprising a post-use fluid clean-out flow path including a tee-fitting disposed in the flow path between said metering orifice and said second check valve, and said tee-fitting includes a branch port fluidly coupled to said first input port via a user selectable, normally closed, valve means whereby by disconnecting said source of liquid chemical concentrate, and opening said selectable valve means, with said nozzle open, said first pressurized water will be caused to back-flush the entire system and clear any clogs therefrom.

5. A fire retardant concentrate proportioning system and apparatus as recited in claim 1 wherein said metering orifice is sized to create a vendor specified ratio between the liquid chemical concentrate flow at said suction port and the mixture flow at the nozzle.

6. A system and apparatus for proportioning and mixing one or more concentrated liquid fire retardant chemicals with another liquid, comprising:

a first input port for connection to a source of said another liquid pressurized to a first pressure;

a selectably variable pressure regulator connected to said first input port for reducing the pressure of a stream of said another liquid input thereto from said first pressure to a selected second pressure;

a second input port for connection through a metering orifice to at least one source of liquid fire retardant chemicals having a predetermined concentration;

an output port for connection to the proximal end of a distribution-hose having a discharge nozzle operatively mounted to the distal end thereof;

an eductor means having a motive port fluidly coupled to said pressure regulator for receiving a stream of said another liquid pressurized thereby to said selected second pressure, a suction port fluidly coupled to said second input port for receiving the concentrated liquid fire retardant chemicals from said source thereof, and a discharge port fluidly connected to said output port;

a first check valve fluidly coupled between said pressure regulator and said motive port for limiting the direction of fluid flow of said pressurized stream of said another liquid from said pressure regulator to said motive port; and a second check valve fluidly coupled between said second input port and said suction port for limiting the direction of fluid flow of said concentrated liquid fire retardant chemicals from said second input port to said suction port;

said eductor means being configured to allow a constant and fixed flow rate of said another liquid therethough at said second pressure such that the velocity of flow of said another liquid therethrough is constant and induces a negative pressure at said suction port sufficient to draw a pre-specified flow of said concentrated liquid chemicals through said second input port and said first metering orifice into said eductor means wherein it becomes mixed with said stream of pressurized another liquid, and the resultant mixture is discharged from said discharge port to said output port.

7. A system and apparatus as recited in claim 6 wherein said selectably variable pressure regulator is a pressure relief valve having an adjustment screw and an associated branch port and by-pass linkage for returning excess pressurized liquid to the source of said another liquid.

8. A system and apparatus as recited in claim 7 wherein said selectably variable pressure regulator further includes a pressure gauge for indicating the pressure of said another liquid input to said eductor means as said adjustment screw is adjusted to reduce said first pressure to said second pressure.

9. A system and apparatus as recited in claim 6 and further comprising means forming a post-use fluid clean-out flow path including a tee-fitting disposed in the flow path between said metering orifice and said second check valve, and said tee-fitting includes a branch port fluidly coupled to said first input port via a user selectable, normally closed, valve means, whereby by disconnecting said at least one source of liquid fire retardant chemicals, and opening said selectable valve means, with said discharge nozzle open, said first pressurized another liquid will be caused to back-flush the entire system and clear any clogs therefrom.

10. A system and apparatus as recited in claim 6 wherein said metering orifice is sized to create a 70 percent ratio between the concentrate flow rate and the mixture flow rate at the discharge nozzle.

* * * * *